US005780921A

United States Patent [19]

Mitsuishi

[11] Patent Number: 5,780,921

[45] Date of Patent: Jul. 14, 1998

[54] BIPOLAR TRANSISTOR CONSTANT VOLTAGE SOURCE CIRCUIT

[75] Inventor: Masafumi Mitsuishi, Tokyo, Japan

[73] Assignee: NEC Corporation, Tokyo, Japan

[21] Appl. No.: 703,405

[22] Filed: Aug. 26, 1996

[30] Foreign Application Priority Data

Aug. 30, 1995 [JP] Japan ..... 7-220962

[51] Int. Cl.[6] ..... F02P 3/05

[52] U.S. Cl. ..... 257/578; 323/313; 323/314; 323/303; 307/296.6; 307/296.7

[58] Field of Search ..... 257/578; 323/314, 323/313, 317, 907, 224, 284, 275, 303, 231; 307/296.6, 296.7

[56] References Cited

U.S. PATENT DOCUMENTS

| | | | |
|---|---|---|---|
| 4,608,529 | 8/1986 | Mallinson | 323/275 |
| 5,049,806 | 9/1991 | Urakawa et al. | 323/314 |
| 5,603,308 | 2/1997 | Ooyabu et al. | 323/284 |

FOREIGN PATENT DOCUMENTS 3194610 8/1991 Japan .

*Primary Examiner*—Carl W. Whitehead, Jr.
*Attorney, Agent, or Firm*—Sughrue, Mion, Zinn, Macpeak & Seas, PLLC

[57] ABSTRACT

A bipolar transistor constant voltage source circuit includes a first transistor having a collector connected through a first resistor to VCC, an emitter connected through a second resistor to ground, and a base connected to receive a reference voltage. The collector of the first transistor is connected to a base of a second transistor having a collector connected to VCC and an emitter connected to the ground through third and fourth resistors connected in series. A connection node between the third and fourth resistors is connected to a base of a third transistor having a collector connected through a fifth resistor to VCC and an emitter connected through a sixth resistor to the ground. The very simple circuit construction thus formed can supply from the collector of the third transistor an output voltage which becomes equal to VCC when VCC is still low just after the overall semiconductor integrated circuit including the constant voltage source circuit has been powered on, and which can be set, in a constant voltage outputting condition, to an arbitrary level which is influenced by neither variation in temperature nor variation in VCC.

18 Claims, 3 Drawing Sheets

BIPOLAR TRANSISTOR CONSTANT VOLTAGE SOURCE CIRCUIT

BACKGROUND OF THE INVENTION

1. Field of the Invention

The present invention relates to a constant voltage source circuit, and more specifically to a bipolar transistor constant voltage source circuit suitable to an semiconductor integrated circuit.

2. Description of Related Art

Referring to FIG. 1, there is shown a circuit diagram of a first typical prior art example of the bipolar transistor constant voltage source circuit, called a "Widlar type bandgap circuit ", which is configured to generate a constant voltage independent of a temperature and of a power supply voltage, by use of a base-emitter voltage of a bipolar transistor.

As shown in FIG. 1, a constant voltage output VBG is outputted from an emitter of a bipolar transistor B8, which in turn have a collector connected to a power supply voltage VCC and a base connected through a resistor R11 to the power supply voltage VCC.

The base of the transistor B8 is also connected to a collector of a bipolar transistor B7, which has an emitter connected to ground GND, which gives a reference voltage. Between an output terminal of VBG and the ground GND, a resistor R9, a bipolar transistor B6 and a resistor R10 are connected is series to each other in the named order. A collector of the transistor B6 is connected to a base of the transistor B7.

Furthermore, between the output terminal of VBG and the ground GND, a resistor R8 and a bipolar transistor B5 connected in the form of a diode, are connected in series to each other in the named order. A base of the transistor B5 is connected to a base of the transistor B6.

With the above mentioned circuit arrangement, a current flowing through the resistor R9 is determined by a base-emitter voltage VBE1 of the transistor B5, a base-emitter voltage VBE2 of the transistor B6 having an emitter area larger than that of the transistor B5, and the resistance of the resistor R10. A constant voltage of about 1.2 V measured from the ground voltage is generated, which is the sum of a voltage VR9 created by the current flowing through the resistor R9 and a base-emitter voltage VBE3 of the transistor B7.

In the above mentioned voltage generation process, the base-emitter voltage of each of the bipolar transistors is not influenced to variation in the power supply voltage. However, the base-emitter voltage VBE3 has a negative temperature characteristics that if the temperature elevates, VBE3 decreases, and on the other hand, the voltage VR9 has a positive temperature characteristics that if the temperature elevates, VR9 increases. Therefore, by adjusting the resistance of the resistors R9 and R10, it becomes possible to supply the output voltage VBG depending upon neither the power supply voltage nor the temperature.

Referring to FIG. 2, there is shown a graph illustrating a characteristics of the output voltage VBG versus the power supply voltage VCC in the circuit shown in FIG. 1.

The circuit shown in FIG. 1 has a problem that the output voltage VBG becomes unstable when the power supply voltage supplied into an internal of a semiconductor integrated circuit from an external portion is still low just after the overall semiconductor integrated circuit, including the constant voltage source circuit, has been powered on.

Therefore, when the circuit shown in FIG. 1 is ordinarily used, the output terminal of VBG is connected through a resistor to either the power supply voltage VCC or the ground potential GND. In the graph of FIG. 2, the curve VBG(C1) is indicative of the case that the output terminal of VBF is connected through the resistor to the ground potential GND, and the curve VBG(C2) represents the case that the output terminal of VBG is connected through the resistor to the power supply voltage VCC. In both cases, the characteristics shows that the constant voltage of about 1.2 V is outputted if the power supply voltage VCC is not smaller than about 2 V.

Referring to FIG. 3, there is shown a circuit diagram of a second prior art example of the bipolar transistor constant voltage source circuit, which is disclosed in Japanese Patent Application Laid-open Publication No. JP-A-3-194610.

This second prior art example is characterized in that, by using a voltage dividing circuit consisting of resistors R12 and R13 connected in series between a power supply voltage VCC and ground GND, a base voltage and an emitter voltage of a bipolar transistor B9 and hence a base voltage and an emitter voltage of a bipolar transistor B10 are controlled, and the emitter voltage of the transistor B10 is amplified by resistors R15 and R16 in a direction opposite to a varying direction of the power supply voltage. Thus, an output voltage VO independent of the power supply voltage is outputted.

Specifically, the output voltage VO is expressed by the following equation (1):

$$VO=A1\cdot VCC+A2\cdot VBE \quad (1)$$

where $$A1=1-[R13\cdot R16/\{R15\cdot(R12+R13)\}] \quad (2)$$

$$A2=2\cdot R16/R15 \quad (3)$$

VBE=base-emitter voltage

Therefore, the influence of VCC can be cancelled by setting the circuit to fulfil A1=0, namely, $$R13/(R12+R13)=R15/R16 \quad (4)$$

However, the above mentioned prior art examples of bipolar transistor constant voltage source circuit have the following problems:

In the constant voltage source circuit shown in FIG. 1, the output voltage is fixed to about 1.2 V measured from the ground potential, and therefore, a voltage other than about 1.2 V cannot be generated.

As shown in FIG. 2, the constant voltage source circuit shown in FIG. 1 has such a characteristics that, when the power supply voltage is still low just after the overall semiconductor integrated circuit including the constant voltage source circuit has been powered on, the output voltage of the constant voltage source circuit cannot become equal to the power supply voltage supplied from the external. Therefore, when the output voltage of the constant voltage source circuit shown in FIG. 1 is used as an internal stepped-down reference power supply voltage in the semiconductor integrated circuit, an internal circuit supplied with the internal stepped-down reference power supply voltage can have only a reduced operation margin during a period that the power supply voltage is still low just after the overall semiconductor integrated circuit including the constant voltage source circuit has been powered on.

In the constant voltage source circuit shown in FIG. 3, on the other hand, since the equation (1) as mentioned above includes the term of the base-emitter voltage VBE of the bipolar transistor, and since this term cannot be extinguished as seen from the equation (3), the output voltage is inevitably influenced by the temperature dependency of the base-emitter voltage VBE.

SUMMARY OF THE INVENTION

Accordingly, it is an object of the present invention to provide a bipolar transistor constant voltage source circuit which has overcome the above mentioned defects of the conventional ones.

Another object of the present invention is to provide a bipolar transistor constant voltage source circuit of a simple circuit construction and capable of supplying an output voltage which becomes equal to a power supply voltage when the power supply voltage is still low just after the overall semiconductor integrated circuit including the constant voltage source circuit has been powered on, and which can be set, in a constant voltage outputting condition, to an arbitrary level which is influenced by neither variation in the temperature nor variation in the power supply voltage.

The above and other objects of the present invention are achieved in accordance with the present invention by a bipolar transistor constant voltage source circuit comprising:

an input stage current path circuit constituted of a first resistor, a first bipolar transistor and a second resistor connected in series in the named order between a power supply voltage and a reference potential point, the first bipolar transistor having a base connected to receive a reference voltage;

an intermediate stage current path circuit constituted of a second bipolar transistor, a third resistor and a fourth resistor connected in series in the named order between the power supply voltage and the reference potential point, the second bipolar transistor having a base connected to a collector of the first bipolar transistor;

an output stage current path circuit constituted of a fifth resistor, a third bipolar transistor and a sixth resistor connected in series in the named order between the power supply voltage and the reference potential point, the third bipolar transistor having a base connected to a connection node between the third and fourth resistors; and an output terminal connected to a collector of the third bipolar transistor to supply a constant voltage outputted from the collector of the third bipolar transistor.

In one embodiment, a circuit for generating the above mentioned reference voltage is constituted of a fourth bipolar transistor having a base and a collector connected to each other and also connected to the base of the first transistor so that a current mirror circuit is constituted of the first and fourth bipolar transistors.

As seen from the above, in the output stage current path circuit constituted of the fifth resistor, the third bipolar transistor and the sixth resistor connected in series in the named order between the power supply voltage and the reference potential point, the output terminal is connected to the collector of the third bipolar transistor, and the third bipolar transistor constitutes an inverting amplifier. Therefore, when the power supply voltage is still low just after the overall semiconductor integrated circuit including the constant voltage source circuit has been powered on, since the third transistor is maintained off, the output terminal is pulled up to the power supply voltage through the fifth resistor. Namely, the output voltage can be made equal to the power supply voltage.

In the input stage current path circuit constituted of the first resistor, the first bipolar transistor and the second resistor connected in series in the named order between the power supply voltage and the reference potential point, the reference voltage is supplied to the base of the first bipolar transistor which also acts an inverting amplifier. In addition, in the intermediate stage current path circuit constituted of the second bipolar transistor, the third resistor and the fourth resistor connected in series in the named order between the power supply voltage and the reference potential point, the second bipolar transistor constitutes an emitter follower, and the third resistor and the fourth resistor constitutes a voltage dividing resistor circuit. The collector of the first bipolar transistor in the input stage current path circuit is connected to the base of the second bipolar transistor of the intermediate stage current path circuit, and a divided voltage output from the voltage dividing resistor circuit is supplied to the base of the third bipolar transistor in the output stage current path circuit.

With this arrangement, the output voltage characteristics and the temperature characteristics are determined by a resistance ratio between the resistors included in the three current path circuits, and therefore, becomes insensitive to variation in resistance value of the respective resistors, since a desired resistance ratio can be relatively easily realized regardless of variation in manufacturing process which makes it difficult to realize a resistor having a desired resistance. In addition, by changing the resistance ratio between the resistors included in the three current path circuits, it is possible to adjust or control the power supply voltage dependency characteristics and the temperature characteristics and hence the output voltage.

The above and other objects, features and advantages of the present invention will be apparent from the following description of preferred embodiments of the invention with reference to the accompanying drawings.

DESCRIPTION OF THE PREFERRED EMBODIMENTS

Now, embodiments of the bipolar transistor constant voltage source circuit in accordance with the present invention will be described with reference to the accompanying drawings. The following description will be made on condition that the lowest voltage is a ground potential GND, and the highest voltage is a power supply voltage VCC.

Figure 4:
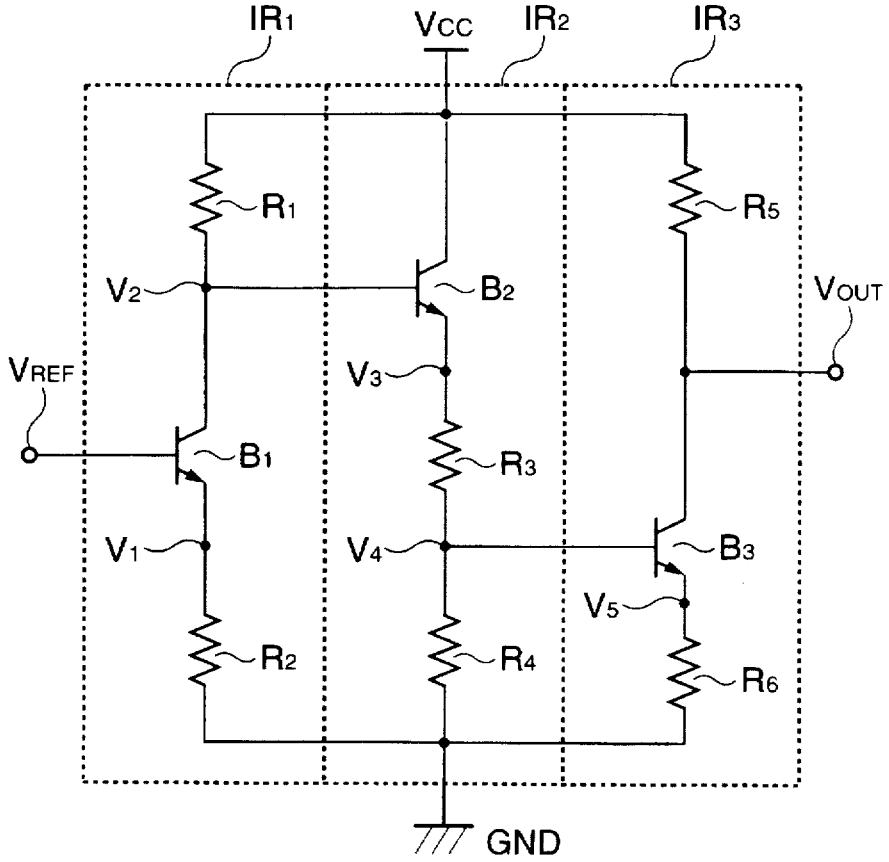
FIG. 4 is a circuit diagram of a first embodiment of the bipolar transistor constant voltage source circuit in accordance with the present invention.

Referring to FIG. 4, there is shown a circuit diagram of a first embodiment of the bipolar transistor constant voltage source circuit in accordance with the present invention.

As shown in FIG. 4, the shown embodiment includes an input stage current path circuit IR1, an intermediate stage current path circuit IR2, and an output stage current path circuit IR3. A reference voltage VREF is supplied to a base of an inverting amplifier transistor B1 included in the input stage current path circuit IR1, and a constant output voltage VOUT is outputted from a collector of an inverting amplifier transistor B3 included in the output stage current path circuit IR3.

Here, is it assumed that the reference voltage VREF does not vary dependently upon the power supply voltage VCC and the temperature. As this reference voltage VREF, an output voltage of the Widlar type bandgap circuit shown in FIG. 1 can be used.

The input stage current path circuit IR1 is constituted of a resistor R1, the bipolar transistor B1 and another resistor R2 connected in series in the named order between the power supply voltage VCC and the ground GND. The intermediate stage current path circuit IR2 is constituted of an emitter follower bipolar transistor B2 and resistors R3 and R4 connected in series in the named order between the power supply voltage VCC and the ground GND. The output stage current path circuit IR3 is constituted of a resistor R5, the bipolar transistor B3 and another resistor R6 connected in series in the named order between the power supply voltage VCC and the ground GND.

In addition, a voltage V2 at a collector of the transistor B1 is supplied to a base of the transistor B2, and a voltage V4 at a connection node between the resistors R3 and R4 (namely, a voltage V3 at an emitter of the transistor B2 divided by a voltage dividing circuit composed of the resistors R3 and R4) is supplied to a base of the transistor B3.

Now, operation of the shown circuit will be described.

When the power supply voltage is still low just after the overall semiconductor integrated circuit including the constant voltage source circuit has been powered on, the output voltage VOUT becomes equal to VCC. The output VOUT is connected through the resistor R5 to the power supply voltage VCC, and also connected through the transistor B3 and the resistor R6 to the ground GND. Therefore, when the transistor B3 is off, namely, when no current flows through the resistor R5, the output VOUT is pulled through the resistor R5 so that the output voltage VOUT becomes equal to VCC. However, if the power supply voltage VCC exceeds a certain voltage, the transistor is turned on, so that the output voltage VOUT is no longer equal to VCC.

Ignoring the base current of each transistor and assuming that the base-emitter voltage VBE of the respective transistors are equal to each other, a power supply voltage VCCON at the moment the transistor B3 starts to be turned on, is the lowest when the transistor B1 is in an off condition, and is expressed as follows:

$$VCCON=VBE(2+R3/R4) \quad (5)$$

Here, assuming that VBE is 0.8 V, since (R3/R4)>0, the following equation can be obtained:

$$VCCON>1.6V \quad (6)$$

It could be understood from the equation (5) that the value of VCCON can become large by making the value of the R3/R4 large.

Figure 1:
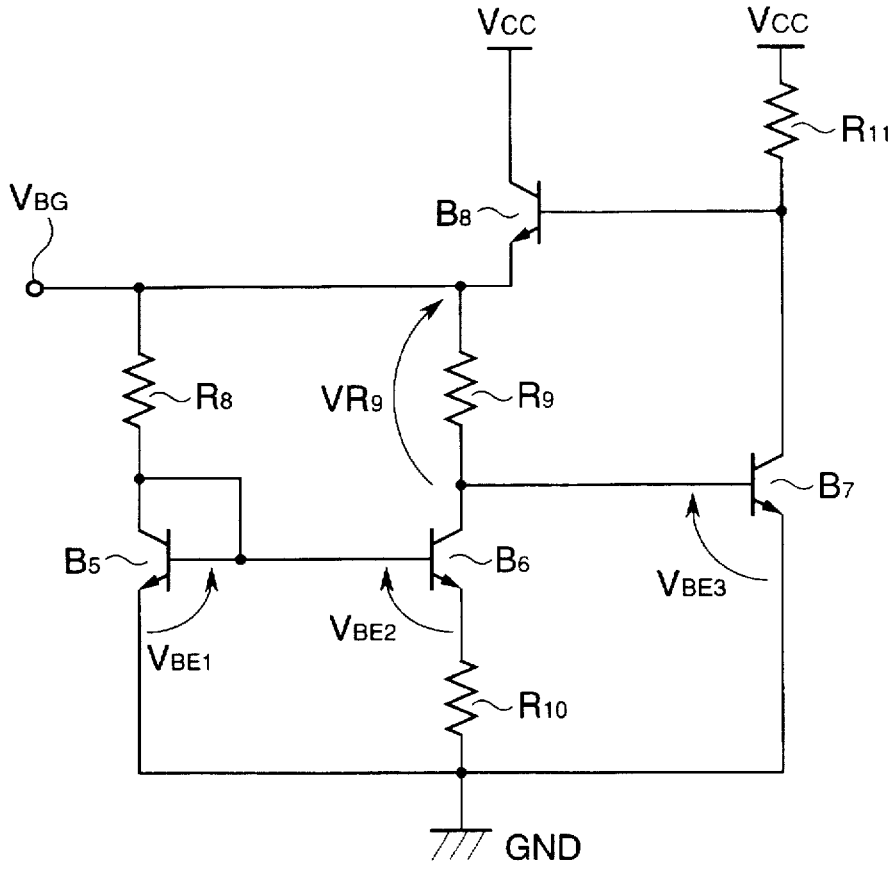
FIGURE 1 PRIOR ART
FIG. 1 is a circuit diagram of a first typical prior art example of bipolar transistor constant voltage source circuit.
Figure 2:
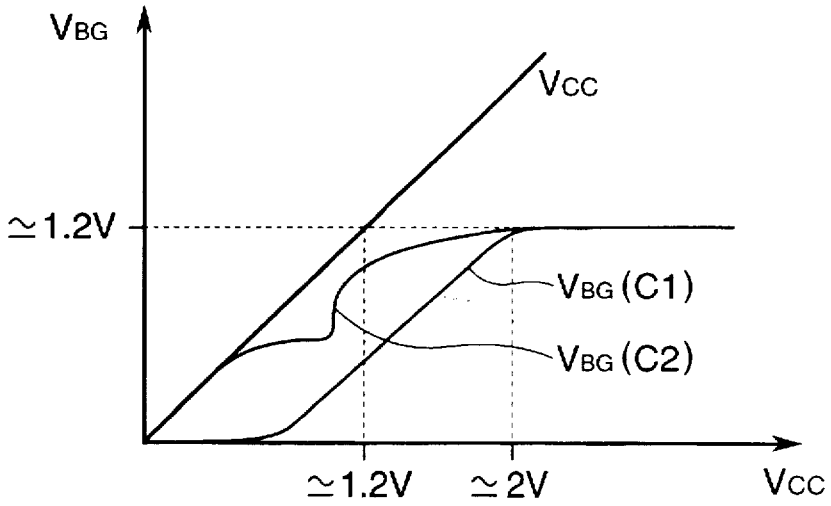
FIGURE 2 PRIOR ART
FIG. 2 is a graph illustrating a characteristics of the output voltage versus the power supply voltage in the circuit shown in FIG. 1.
Figure 3:
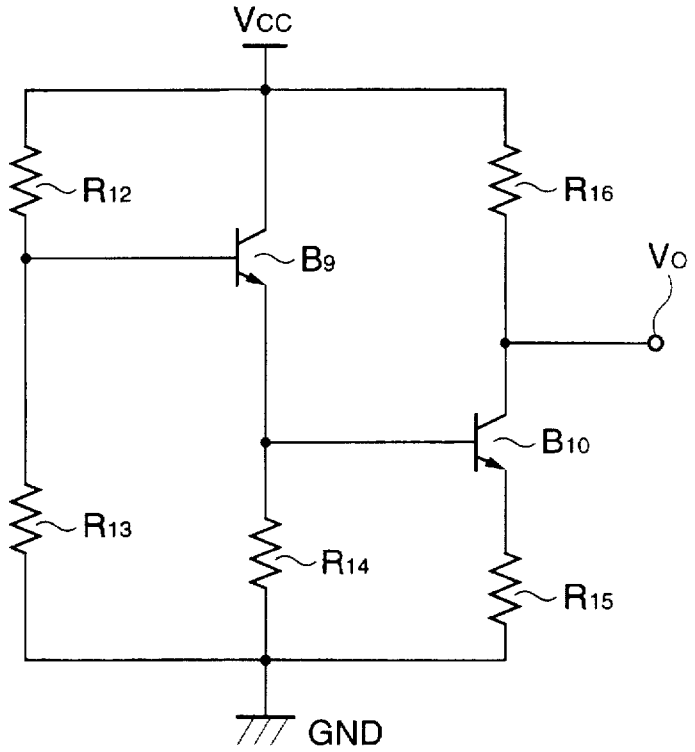
FIGURE 3 PRIOR ART
FIG. 3 is a circuit diagram of a second typical prior art example of bipolar transistor constant voltage source circuit.

For example, assuming that, as the reference voltage VREF, there is used the output voltage of the circuit shown in FIG. 1 which outputs the constant voltage of about 1.2 V when the power supply voltage supplied from the external is not smaller than 2.0 V, if the value of the R3/R4 is set to a value of not less than 0.5, VOUT can be made equal to VCC independently of VREF when the power supply voltage supplied actually into an internal of a semiconductor integrated circuit from the external is still low just after the overall semiconductor integrated circuit including the constant voltage source circuit has been powered on.

Furthermore, the obtained output voltage VOUT is influenced by neither the variation in the power supply voltage nor the variation in the temperature. Voltages V1, V2, V3, V4, V5 and VOUT on various nodes in the circuit shown in FIG. 4 can be expressed as follows:

$$V1=VREF-VBE \quad (7)$$

$$V2=VCC-V1(R1/R2)=VCC-V1\cdot C1 \quad (8)$$

$$V3=V2-VBE \quad (9)$$

$$V4=V3\{R4/(R3+R4)\}=V3\cdot C2 \quad (10)$$

$$V5=V4-VBE \quad (11)$$

$$VOUT=VCC-V5(R5/R6)=VCC-V5\cdot C3 \quad (12)$$

where $$C1=R1/R2 \quad (13)$$

$$C2=R4/(R3+R4) \quad (14)$$

$$C3=R5/R6 \quad (15)$$

Here, if the equations (7) to (11) are substituted in the equation (12), the equation (12) can be expressed as follows:

$$VOUT=VCC(1-C2\cdot C3)+C1\cdot C2\cdot C3\cdot VREF+VBE(C3+C2\cdot C3-C1\cdot C2\cdot C3) \quad (16)$$

Here, assume that variations in VOUT, VCC, VREF and VBE due to variation in VCC are expressed as ΔVoutc, ΔVccc, ΔVrefc and ΔVbec, respectively. Since ΔVrefc and ΔVbec are zero (0) and ΔVccc is 1, if the solution for ΔVoutc=0 is sought from the equation (16), the solution is $$C3=1/C2 \quad (17)$$

This is the equation for the condition that the output voltage is not influenced by the variation in the power supply voltage.

Furthermore, assume that variations in VOUT, VCC, VREF and VBE due to variation in temperature are expressed as ΔVout, ΔVcct, ΔVreft and ΔVbet, respectively. Since ΔVcct and ΔVreft are zero (0), if the solution for ΔVoutt=0 is sought from the equation (16), the solution is $$1/C2=C1-1 \quad (18)$$

This is the equation for the condition that the output voltage is not influenced by the variation in temperature.

Thus, if the equations (17) and (18) are substituted in the equation (16), the following equation can be obtained:

$$VOUT/VREF=C1\cdot C2\cdot C3 \quad (19)$$

This is the equation for the condition for arbitrarily setting the output voltage level.

Now, in the circuit shown in FIG. 4, the resistance value of the resistors R1, R2, R3, R4, R5 and R6 are determined as follows:

R1=1.5 kΩ, R2=0.5 kΩ, R3=R4=R6=1.0 kΩ, R5=2.0 kΩ

If these values are substituted in the equations (13), (14) and (15), it becomes C1=3, C2=0.5 and C3=2, and therefore, the equations (17) and (18) can hold. Accordingly, assuming VREF=1.2 V, the output voltage can be expressed as follows from the equation (19):

$$VOUT=3.6\ V$$

Thus, the output voltage becomes a constant level of 3.6 V which is independent of either the power supply voltage or the temperature.

Furthermore, assuming VBE=0.8 V, VCCON can be expressed as follows from the equation (5):

$$VCCON=2.4\ V$$

Therefore, since the relation of VCCON>VREF can hold, the output voltage VOUT becomes equal to the power supply voltage VCC, when the power supply voltage is still low just after the overall semiconductor integrated circuit including the constant voltage source circuit has been powered on, independently of variation in VREF, which may occur when the circuit is powered on.

Figure 5:
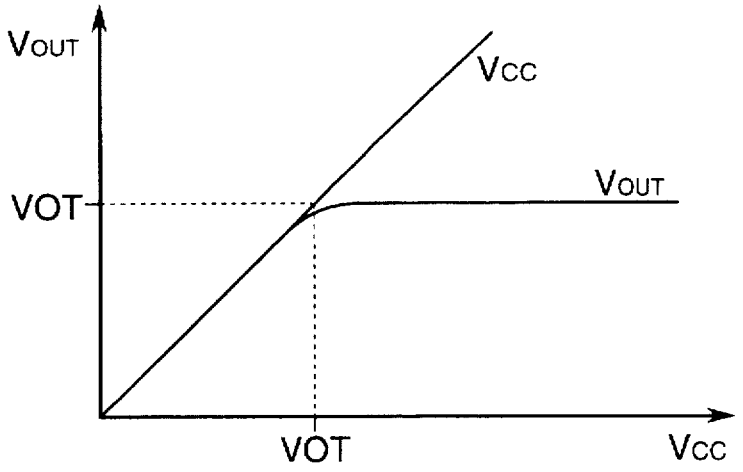
FIG. 5 is a graph illustrating a characteristics of the output voltage versus the power supply voltage in the circuit shown in FIG. 4.

Referring to FIG. 5, there is shown a graph illustrating a characteristics of the output voltage VOUT versus the power supply voltage VCC in the circuit shown in FIG. 4.

As seen from FIG. 5, the output voltage VOUT becomes equal to the power supply voltage VCC from the moment that the overall semiconductor integrated circuit including the constant voltage source circuit is powered on, namely, when the power supply voltage is low. And, the output voltage VOUT becomes a constant voltage VOT if the power supply voltage VCC becomes not less than VOT.

Figure 6:
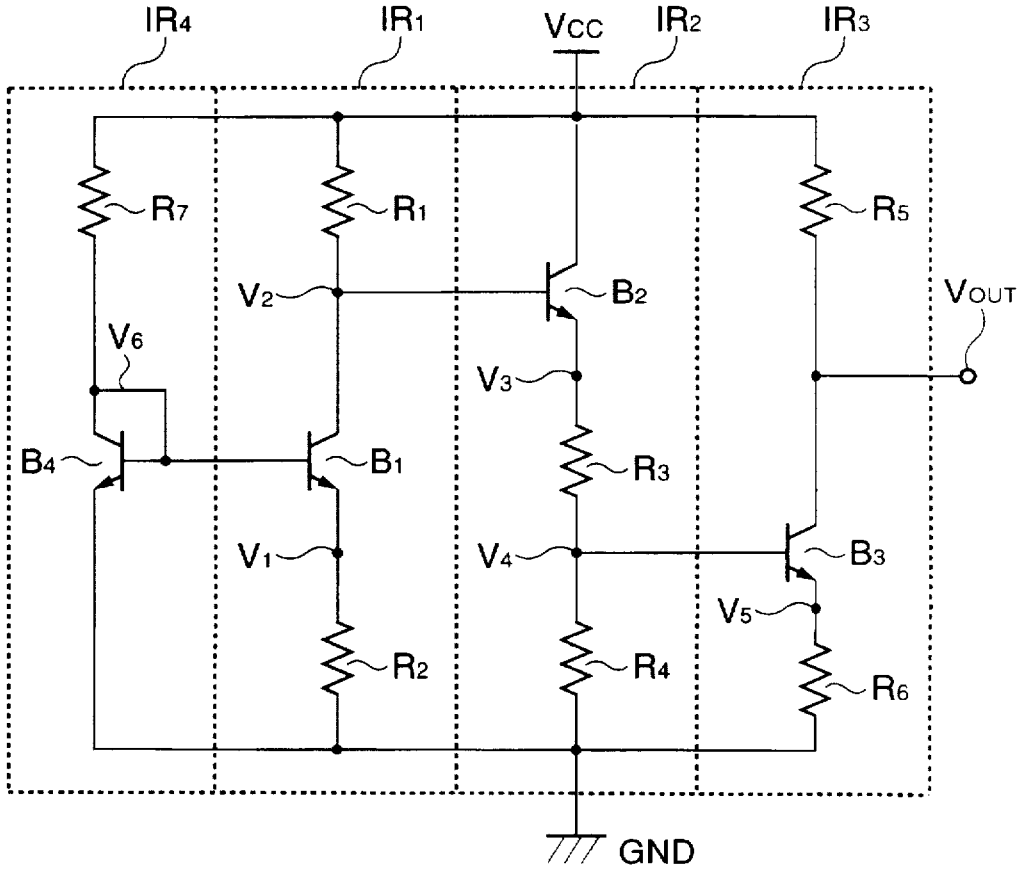
FIG. 6 is a circuit diagram of a second embodiment of the bipolar transistor constant voltage source circuit in accordance with the present invention.

Referring to FIG. 6, there is shown a circuit diagram of a second embodiment of the bipolar transistor constant voltage source circuit in accordance with the present invention. In FIG. 6, elements similar to those shown in FIG. 4 are given the same Reference Numerals, and explanation thereof will be omitted.

As seen from comparison between FIGS. 4 and 6, the second embodiment is characterized in that a current path circuit IR4 for a current mirror is added to the circuit shown in FIG. 4, instead of using the external reference voltage VREF.

This current path circuit IR4 is constituted of a resistor R7 and a bipolar transistor B4 connected in series between the power supply voltage VCC and the ground GND. The transistor B4 has a base and a collector connected to each other so as to assume a diode connection structure. The base of the transistor B4 is connected to the base of the transistor B1, so that a current mirror is constituted.

These transistors B1 and B4 are so designed that an emitter area of the transistor B1 is larger than that of the transistor B4. Here, assuming that the circuit is designed in such a manner that the current flowing through the transistor B1 and the current flowing through the transistor B4 are the same value, and that the emitter area of the transistor B1 is "A" times the emitter area of the transistor B4, the node voltage V1 is expressed as follows:

$$V1=Vt\cdot lnA \tag{20}$$

where $$Vt=k\cdot T/q \tag{21}$$

k=Boltzmann constant, q=elementary charge, and

T=absolute temperature

If the output voltage VOUT is obtained by replacing the equation (7) with this equation (20), the output voltage VOUT can be expressed as follows:

$$VOUT=VCC(1-C2\cdot C3)+VBE(C3+C2\cdot C3)+C1\cdot C2\cdot C3\cdot Vt\cdot lnA \tag{22}$$

From this equation, in order to eliminate the VCC dependency of the output voltage VOUT, it is sufficient if the first item of the right side of the equation (22) is made zero (0). The condition for this purpose is $$C3=1/C2 \tag{23}$$

This equation is the same as the equation (17).

Examining the temperature dependency, it is assumed that VBE exhibits a negative temperature characteristics, and can be approximately expressed by a first order or linear function of the temperature T. Accordingly, the change amount ΔVbet2 of VBE due to change in temperature becomes a negative constant value expressed as follows:

$$\Delta Vbet2=-D \tag{24}$$

where D is a constant independent of T.

Furthermore, if the change amount ΔVoutt2 in VOUT due to change in temperature is obtained from the equation (22), and if the equations (21) and (24) are substituted in the obtained equation, the following equation can be obtained:

$$\Delta Voutt2=-D\cdot(C3+C2\cdot C3)+C1\cdot C2\cdot C3\cdot(k/q)\cdot lnA \tag{25}$$

Therefore, solving the condition for ΔVoutt2=0, the following equation is obtained.

$$D\cdot C3(1+C2)=C1\cdot C2\cdot C3\cdot(k/q)\cdot lnA \tag{26}$$

Furthermore, the equation (23) is substituted int the equation (26)

$$C1/(C3+1)=D/\{(k/q)\cdot lnA\} \tag{27}$$

This is the equation for the condition that the output voltage is independent of variation in temperature.

Additionally, the circuit of FIG. 6 is so designed that when the node voltage V6 becomes 0.8 V, the transistor B1 is turned on. However, since the node for V6 is connected through the resistor R7 to the power supply voltage VCC, the node voltage V6 is equal to VCC if VCC<0.8 V, and is fixed to about 0.8 V by action of the transistor B4 if VCC≧0.8 V. Therefore, since the transistor B1 is turned on at VCC=V6=0.8 V, it would be understood from comparison with the equation (6) that the output voltage VOUT becomes equal to VCC when the power supply voltage is still low just after the overall semiconductor integrated circuit including the constant voltage source circuit has been powered on.

Therefore, it would be apparent that the circuit of FIG. 6 exhibits the same characteristics as that shown in the graph of FIG. 5.

As seen from the above, the bipolar transistor constant voltage source circuit in accordance with the present invention is characterized by comprising the input stage current path circuit receiving an external reference voltage, the intermediate stage current path circuit having the voltage dividing function and the output stage current path circuit having an inverting amplifying function, which are connected to each other to mutually cancel the dependency to the power supply voltage variation and the temperature variation. Therefore, the bipolar transistor constant voltage source circuit in accordance with the present invention has a very simple construction and can supply the output voltage which becomes equal to a power supply voltage when the power supply voltage is still low just after the overall semiconductor integrated circuit including the constant voltage source circuit has been powered on, and which can be set, in a constant voltage outputting condition, to an arbitrary level which is influenced by neither variation in the temperature nor variation in the power supply voltage.

Furthermore, if the fourth current path circuit composed of the transistor and the resistor is added to the input stage current path circuit, the external reference voltage can be omitted, and therefore, the circuit construction can be further simplified.

The invention has thus been shown and described with reference to the specific embodiments. However, it should be noted that the present invention is in no way limited to the details of the illustrated structures but changes and modifications may be made within the scope of the appended claims.

I claim:

1. A bipolar transistor constant voltage source circuit comprising:

an input stage current path circuit having, in order, a first resistor, a first bipolar transistor and a second resistor, connected in series between a power supply voltage and a reference potential point, said first bipolar transistor having a base connected to receive a reference voltage;

an intermediate stage current path circuit having, in order, a second bipolar transistor, a third resistor and a fourth resistor, connected in series between said power supply voltage and said reference potential point, said second bipolar transistor having a base connected to a collector of said first bipolar transistor;

an output stage current path circuit having, in order, a fifth resistor, a third bipolar transistor and a sixth resistor, connected in series between said power supply voltage and said reference potential point, said third bipolar transistor having a base connected to a connection node between said third and fourth resistors; and an output terminal connected to a collector of said third bipolar transistor to supply a constant voltage outputted from said collector of said third bipolar transistor.

2. A bipolar transistor constant voltage source circuit as claimed in claim 1, further including a fourth circuit for generating said reference voltage, said fourth circuit having a fourth bipolar transistor with a base and a collector connected to each other, said base of said fourth bipolar transistor being connected to said base of said first transistor to form a current mirror circuit comprising said first and fourth bipolar transistors.

3. A bipolar transistor constant voltage source circuit as claimed in claim 1, wherein an emitter area of said first transistor is larger than an emitter area of said fourth transistor.

4. A bipolar transistor constant voltage source circuit as claimed in claim 1, wherein said third, fourth, fifth and sixth resistors are set to fulfil the relation of $C3=1/C2$, where C2 is a ratio of the resistance of said fourth resistor to the sum of the resistances of said third and fourth resistors, and C3 is a ratio of the resistance of said fifth resistance to the resistance of said sixth resistor.

5. A bipolar transistor constant voltage source circuit as claimed in claim 4, wherein said first, second, third and fourth resistors are set to fulfil the relation of $1/C2=C1-1$ where C1 is a ratio of the resistance of said first resistor to the resistance of said second resistor.

6. A bipolar transistor constant voltage source circuit as claimed in claim 5, wherein the ratio of said output voltage to said reference voltage is $C1 \cdot C2 \cdot C3$.

7. A constant voltage source circuit comprising:

an input stage current path circuit having, in order, a first resistor, a first transistor and a second resistor, connected in series between a first supply voltage and a second supply voltage, said first transistor having a first terminal connected to receive a reference voltage;

an intermediate stage current path circuit having, in order, a second transistor, a third resistor and a fourth resistor, connected in series between said first supply voltage and said second supply voltage, a first terminal of said second transistor connected to a second terminal of said first transistor;

an output stage current path circuit having, in order, a fifth resistor, a third transistor and a sixth resistor, connected in series between said first supply voltage and said second supply voltage, a first terminal of said third transistor connected to a connection node between said third and fourth resistors; and an output terminal connected to a second terminal of said third transistor to supply a constant voltage outputted from said collector voltage source circuit.

8. A constant voltage source circuit as claimed in claim 7, further including a fourth circuit for generating said reference voltage, said fourth circuit having a fourth transistor with a first terminal and a second terminal connected to each other in a diode connected configuration, said first terminal of said fourth transistor being connected to said first terminal of said first transistor to form a current mirror circuit comprising said first transistor and said fourth transistor.

9. A constant voltage source circuit as claimed in claim 8, wherein said first transistor and said fourth transistors are bipolar transistors wherein an emitter area of said first transistor is larger than an emitter area of said fourth transistor.

10. A constant voltage source circuit as claimed in claim 7, wherein said first, second, third, fourth, fifth and sixth resistors are set so as to selected a desired constant output voltage independent of temperature and independent of said first supply voltage level when said first supply voltage is above said selected constant output voltage level.

11. A constant voltage source circuit as claimed in claim 10, wherein an output voltage equal to said first supply voltage level is generated when said first supply voltage level is less than said selected constant output voltage level.

12. A constant voltage source circuit comprising:

a first voltage supply and a second voltage supply having a plurality of series current path circuits, each including a transistor, connected therebetween, wherein a first of said plurality of series current path circuits is comprised of an output stage current path circuit having, in order, a first resistor, a first transistor and a second resistor, connected in series between said first voltage supply and said second voltage supply; and an output terminal connected to a node between said first resistor and said first transistor to supply an output voltage of said constant voltage source circuit.

13. A constant voltage source circuit as claimed in claim 12, wherein a second of said plurality of series current path circuits is comprised of an intermediate stage current path circuit having, in order, a second transistor, a third resistor and a fourth resistor, connected in series between said first voltage supply and said second voltage supply, a first terminal of said first transistor connected to a connection node between said third and fourth resistors.

14. A constant voltage source circuit as claimed in claim 13, wherein a third of said plurality of series current path circuits is comprised of an input stage current path circuit having, in order, a fifth resistor, a third transistor and a sixth resistor, connected in series between said first voltage supply and said second voltage supply, a first terminal of said third transistor connected to receive a reference voltage and a second terminal of said third transistor connected to said fifth resistor and a first terminal of said second transistor.

15. A constant voltage source circuit as claimed in claim 14, wherein said first, second, third, fourth, fifth and sixth resistors are set so as to selected a desired constant output voltage independent of temperature and independent of said first voltage supply level when said first supply voltage is above said selected constant output voltage level.

16. A constant voltage source circuit as claimed in claim 15, wherein an output voltage equal to said first voltage supply level is generated when said first voltage supply level is less than said selected constant output voltage level.

17. A constant voltage source circuit comprising:

a first voltage supply and a second voltage supply;

a means for regulating an output voltage so that said output voltage is independent of temperature and independent of a level of said first voltage supply level when said level of said first voltage supply is above a selected constant output voltage level, and said output voltage is equal to said level of said first voltage supply when said level of said first voltage supply is less than said selected constant output voltage level, wherein said means for regulating an output is connected between said first voltage supply and said second voltage supply.

18. A constant voltage source circuit as claimed in claim 17, wherein said means for regulating an output voltage comprises:

a plurality of series current path circuits connected between said first voltage supply and said second voltage supply, wherein a first of said plurality of series current path circuits is comprised of an output stage current path circuit having, in order, a first resistor, a first transistor and a second resistor, connected in series between said first voltage supply and said second voltage supply; and an output terminal connected to a node between said first resistor and said first transistor to supply an output voltage of said constant voltage source circuit.

* * * * *